United States Patent [19]

Jackson

[11] Patent Number: 4,942,713

[45] Date of Patent: Jul. 24, 1990

[54] INTERCONNECTING STRUCTURE FOR RELEASABLY SECURING SUCCESSIVE PANELS IN A RELOCATABLE WALL

[75] Inventor: Francis G. Jackson, Hudsonville, Mich.

[73] Assignee: Harter Corporation, Sturgis, Mich.

[21] Appl. No.: 364,027

[22] Filed: Jun. 9, 1989

[51] Int. Cl.[5] ..... E04C 1/10

[52] U.S. Cl. ..... 52/584; 52/127.11; 403/407.1

[58] Field of Search ..... 52/584, 127.11, 127.7; 403/407.1, 409.1, 405.1, DIG. 10; 292/190.240, 241

[56] References Cited

U.S. PATENT DOCUMENTS

| | | | |
|---|---|---|---|
| 1,154,622 | 9/1915 | Fangel . | |
| 2,107,624 | 2/1938 | Berger | 20/4 |
| 2,371,300 | 3/1945 | Kaufman | 189/34 |
| 2,548,681 | 4/1951 | Oswald | 292/240 |
| 2,581,816 | 1/1952 | Schlueter | 52/584 |
| 2,787,812 | 4/1957 | Long | 20/4 |
| 2,832,101 | 4/1958 | Stark | 20/4 |
| 2,999,568 | 9/1961 | Ludwig et al. | 189/34 |
| 3,075,253 | 1/1963 | Hammitt et al. | 20/4 |
| 3,194,361 | 7/1965 | Thurman | 189/34 |
| 3,299,594 | 1/1967 | Kellert | 52/262 |
| 3,377,756 | 4/1968 | Polhamus | 52/220 |
| 3,429,601 | 2/1969 | Bremers | 287/189.36 |
| 3,488,908 | 1/1970 | Jahn | 52/496 |
| 3,492,766 | 2/1970 | Andrews | 52/36 |
| 3,643,395 | 2/1972 | Schuyler et al. | 52/509 |
| 3,664,073 | 5/1972 | Tucker | 52/584 X |
| 3,694,975 | 10/1972 | Pollock | 52/36 |
| 3,713,257 | 1/1973 | Beavers | 52/36 |
| 3,852,926 | 12/1974 | Papsco | 52/36 |
| 3,919,820 | 11/1975 | Green | 52/396 |
| 4,031,675 | 6/1977 | Roberts et al. | 52/36 |
| 4,094,113 | 6/1978 | Good | 52/222 |
| 4,223,500 | 9/1980 | Clark et al. | 52/584 X |
| 4,439,971 | 4/1984 | Rutherford | 52/584 |
| 4,512,122 | 4/1985 | Berkowitz | 52/584 X |

*Primary Examiner*—Carl D. Friedman

*Attorney, Agent, or Firm*—Renner, Kenner, Greive, Bobak, Taylor & Weber

[57] ABSTRACT

The present invention is directed to an interconnecting stucture (10) for a relocatable wall. The successively adjacent wall panel assemblies (11) are joined in a linear intersection (12) by a cam key block (35) secured to the vertical frame members (21) of the successive wall panel assmelbies (11A and 11B). Cam surfaces (55) and lateral locators (65) are presented from the cam key blocks (35). The lateral locators (65) are of such configuration that when the cam key blocks (35) are disposed in opposed pairs, the lateral locators (65) effect lateral alignment of the cam key blocks (35). A cam key (75) presents at least two pair of locking bolts ( 80 and 81) which extend transversely outwardly from said disk portion (78) of the cam key (75). The lock bolts (80 and 81) are disposed in diametric opposition and are complementary to the cam surfaces (55) on the cam key blocks (35). The cam key (75) is rotatable with respect to the cam key block (35) selectively to position the locking bolts (80 and 81) in engagement with the cam surfaces (55) on the cam key blocks (35). The present invention cam also be employed to join converging wall panel assemblies (11) by the interposition of post arrangements (20) which are adapted to present the requisite cam key blocks (35) for interaction with the cam key blocks on the wall panel assemblies (11). An alternative cam key block (125) is also disclosed, and a variation of the cam key block concept is incorporated in the end cap clip (155).

23 Claims, 9 Drawing Sheets

INTERCONNECTING STRUCTURE FOR RELEASABLY SECURING SUCCESSIVE PANELS IN A RELOCATABLE WALL

TECHNICAL FIELD

The present invention relates generally to relocatable walls. More particularly, the present invention relates to a mechanism for releasably securing the successive adjacent, or converging, panel assemblies in a relocatable wall. Specifically, the present invention relates to a unique locking mechanism, and associated structure, to provide an improved interconnecting structure for releasably securing successive panels in relocatable walls.

BACKGROUND OF THE INVENTION

One commonly used method of joining successively adjacent panels is to provide a laterally movable connecting member which is disposed in a vertical channel formed in the lateral framing members of the panels. The connecting member is movable horizontally from the channel in one wall panel to a position wherein the connecting member is disposed partially in the one panel and partially in a mirror image channel in the successively adjacent panel. The connecting member is then locked into position by keepers, or by tie clips, and plates. Representative structures embodying this prior art concept are shown in U.S. Pat. Nos. 4,031,675 and 2,999,568. The prior art structures use a tool, such as a thin blade or spatula, to move the connecting member horizontally. To accomplish this, the tool must be inserted between the panels into engagement with the connecting member. The outer covering surface of the wall panel is, therefore, provided with a resilient edge portion which will displace to permit the tool to be manipulated in order to effect lateral movement of the connecting member.

It is also known to move the connecting member vertically to cause the member to engage the tie clip, after which the connecting member is lowered to seat on the plate. With this structure, the tool used to lift the connecting member is inserted through an opening in the bottom of the panel. This opening is covered by a molding after assembly.

In the above described structures, the connecting, or joining, member is supported in one vertical channel while the panels are being placed in position to be connected. These systems generally require that a long box like structure be used to house the joining member. The system described in the aforesaid U.S. Pat. No. 4,031,675, for example, requires that a substantial portion of the frame structure, including the vertical support members, be assembled prior to forming the panels together within the frame structure. At least each of the vertical supports must be installed in the frame prior to the erection of the wall using such panel members.

A relatively full range of representative, prior known structures utilized in relocatable walls, and dividers, are disclosed in the following U.S. Pat. Nos. 1,154,66; 2,730,209; 2,787,812; 2,832,101; 3,713,257; 3,492,766; 3,429,601; 3,488,908; 3,852,926; 2,107,624; 3,299,594; 3,075,253; 2,371,300; 3,194,361; 3,377,756,; 3,643,395; and, 3,919,820.

These last mentioned patents, with the exception of U.S. Pat. No. 4,094,113, describe movable walls that are not as adapted to quick assembly, and/or diassembly, as are the first described arrangements. It should be appreciated that the relocatable wall assemblies of the prior art generally require that a frame structure be erected prior to installation of the panel. This requirement hinders any significant change to the length, or location, of the wall. Redesign of the layout must be completed, and the frame must be disassembled, if a change to the length, location or direction of the wall is desired.

SUMMARY OF THE INVENTION

It is, therefore, a primary object of the present invention to provide an improved interconnecting structure for a multi-panel, relocatable wall wherein the adjacent wall panel assemblies are structurally integrated by the interconnecting structure, thereby eliminating the need for a frame structure separate from the wall panel assemblies.

It is another object of the present invention to provide an improved interconnecting structure for a multpanel, relocatable wall, as above, wherein the individual wall panel assemblies are interconnected by a cammed locking structure, opposed components of which are secured to the successively adjacent wall panel assemblies.

It is a further object of the present invention to provide an interconnecting structure for a multi-panel, relocatable wall, as above, wherein the interconnecting structure has cam key block means in facing relation on opposed edges of the successively adjacent wall panel assemblies, the cam key block means being secured in abutment by a cam key means.

It is an even further object of the present invention to provide a multi-panel relocatable wall structure having a improved interconnecting structure, as above, wherein the interconnection is performed by inserting the cam key means in one cam key block means, then bringing the cam key block means on the successively adjacent wall panel assemblies into close proximity and then rotating the cam key means into simultaneous engagement with the cam key block means on the successively adjacent wall panel assembly to force the cam key block means into abutment and thereby maintain the desired interconnection between successively adjacent wall panel assemblies.

It is yet another object of the present invention to provide an improved interconnecting structure for a multi-panel, relocatable wall, as above, which will permit successively adjacent wall panel assemblies to be interlocked in an aligned linear intersection.

It is an even further object of the present invention to provide an improved interconnecting structure for a multi-panel, relocatable wall, as above, which will permit converging wall panel assemblies to be interlocked in a corner, L-intersection, a T-intersection and/or an X-intersection.

These and other objects of the invention, as well as the advantages thereof over existing and prior art forms, which will be apparent in view of the following detailed specification, are accomplished by means hereinafter described and claimed.

In general, an interconnecting structure for a multi-panel, relocatable wall embodying the concepts of the present invention provides a novel interconnecting structure which permits quick assembly of relocatable walls, and equally rapid disassembly of such walls, without the need for a separate, supporting, frame structure. Each wall panel assembly has a self-contained peripheral frame that includes a pair of vertically oriented, substantially rigid, frame members at the lateral edges of each wall panel assembly. The rigid frame members present a vertically extending channel, or groove, which faces outwardly of the wall panel assembly. One or more cam key blocks are secured within each channel by fastening means.

Each cam key block has a cam surface formed therein. Lateral locators are presented from each cam key block. The lateral locator on a cam key block secured to one lateral edge of each wall panel assembly is complementary to the lateral locator on the cam key block secured ot the other lateral edge of each wall panel assembly. Thus, when opposed cam key blocks on successively adjacent wall panel assemblies are brought together during assembly of the relocatable wall, the lateral locators are disposed to interfit and to effect lateral alignment of the opposed cam key blocks, and thereby the successively adjacent wall panel assemblies to which they are secured. This same result obtains when converging wall panel assemblies are secured through the use of an intervening post arrangement which utilizes the interconnecting structure embodying the concepts of the present invention.

A cam key means is employed releasably to secure the two, opposedly aligned, and interfitted, cam key blocks. The cam key has a disk portion with at least two pairs of locking bolts extending transversely outwardly from the disk portion. The pairs of locking bolts are disposed in diametric opposition about the circumference of the disk portion, and the locking bolts have locking surfaces which are complementary to, and engage, the cam surfaces on the cam key blocks. The cam keys are selectively rotatable with respect to the cam key blocks in order to move the pairs of locking bolts into, and out of, engagement with the cam surfaces on the cam key blocks.

One exemplary embodiment of an interconnecting structure for a relocatable wall, with two alternative forms of a cam key lock, are deemed sufficient to effect a full disclosure of the subject invention, are shown by way of example in the accompanying drawings and are described in detail without attempting to show all of the various forms and modifications in which the invention might be embodied; the invention being measured by the appended claims and not by the details of the specification.

DESCRIPTION OF AN EXEMPLARY EMBODIMENT

One representative form of an improved interconnecting structure for a multi-panel, relocatable wall embodying the concepts of the present invention is designated generally by the numeral 10 on the accompanying drawings.

Figure 15:
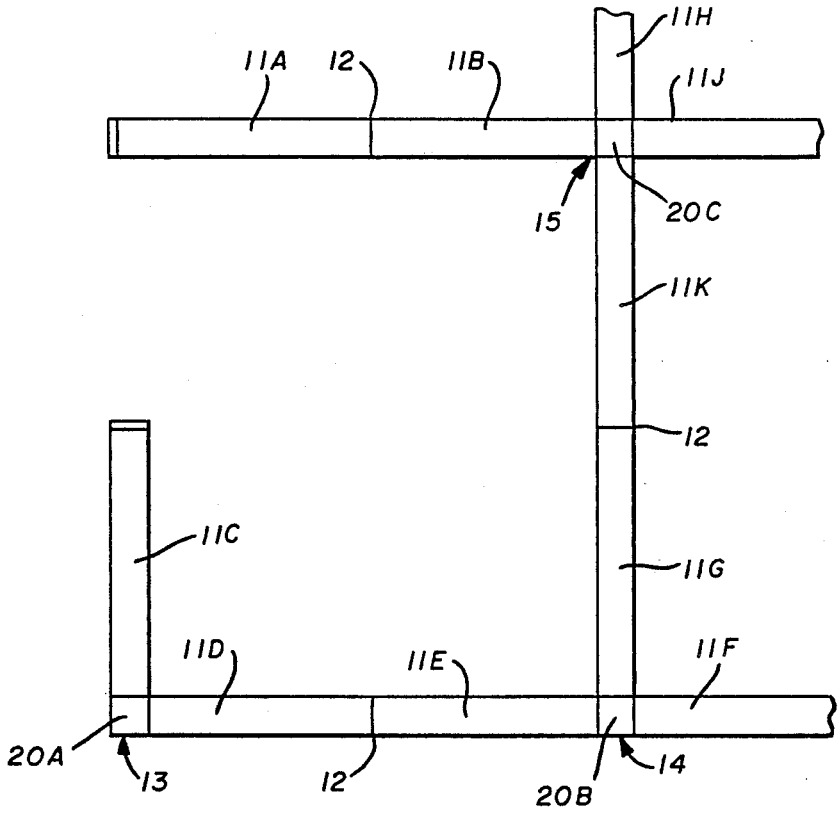
FIG. 15 is a top plan view of a representative, relocatable wall structure using the interconnecting structure of the present invention.
Figure 16:
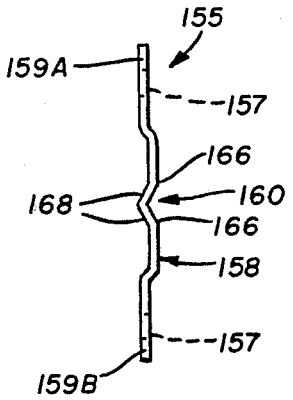
FIG. 16 is an enlarged, side elevation of a further variation on a cam key block embodying the concepts of the present invention, said variation being in the nature of the clip depicted in FIG. 1 and adapted to secure decorative end caps to the lateral edge of a wall panel assembly.
Figure 17:
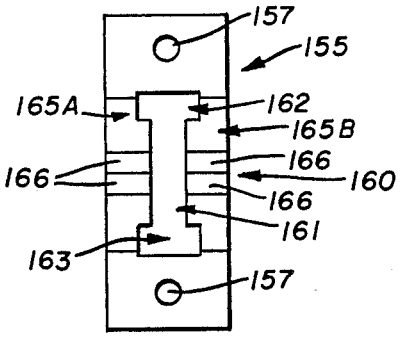
FIG. 17 is a plan view of the clip depicted in FIG. 16.

Referring to the drawings, wherein like characters represent the same of corresponding parts throughout the several views, FIG. 15 depicts a plurality of wall panel assemblies 11 which are disposed to represent usage of the interconnecting structure 10 to effect the most typically required joinder between successively aligned, or converging, wall panel assemblies 11. For example, wall panel assemblies 11A and 11B (as well as wall panel assemblies 11D and 11E and wall panel assemblies 11G and 11K) are depicted as being conjoined in a linear intersection 12 merely by the use of the improved interconnecting structure 10. Wall panel assemblies 11C and 11D are depicted as being conjoined in a corner, L-intersection 13, wall panel assemblies 11E, 11F and 11G are depicted as being conjoined in a T-intersection 14 and wall panel assemblies 11B, 11H, 11J and 11K are depicted as being conjoined in an X-intersection 15. The L-intersection 13, the T-intersection 14 and the X-intersection 15 each utilize a post arrangement 20, but the linear intersection 12 does not require a post arrangement 20. All intersections depicted, however, do utilize the improved interconnecting structure 10.

As may by now be apparent, in the detailed description of the subject invention a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation employed for general identification of that structural member, component or arrangement. Thus, there are at least two wall panel assemblies which are generally identified by the numberal 11, but the specific, individual wall panel assemblies are, therefore, identified as 11A, 11B, 11C, etc. in the specification and on the drawings. This same suffix convention shall be employed throughout the specification.

Figure 1:
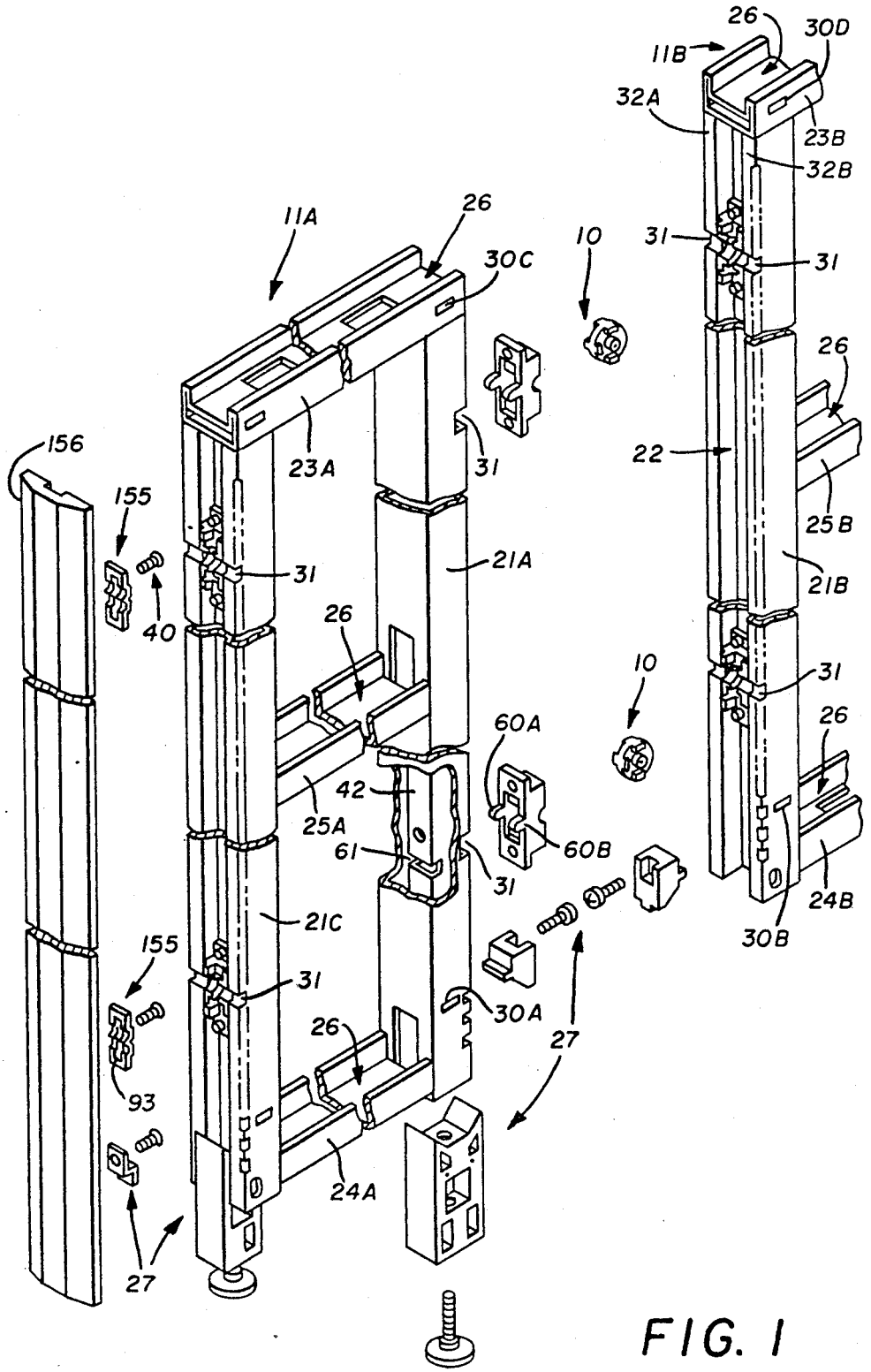
FIG. 1 is an exploded perspective of a relocatable wall structure embodying the concepts of the present invention.
Figure 2:
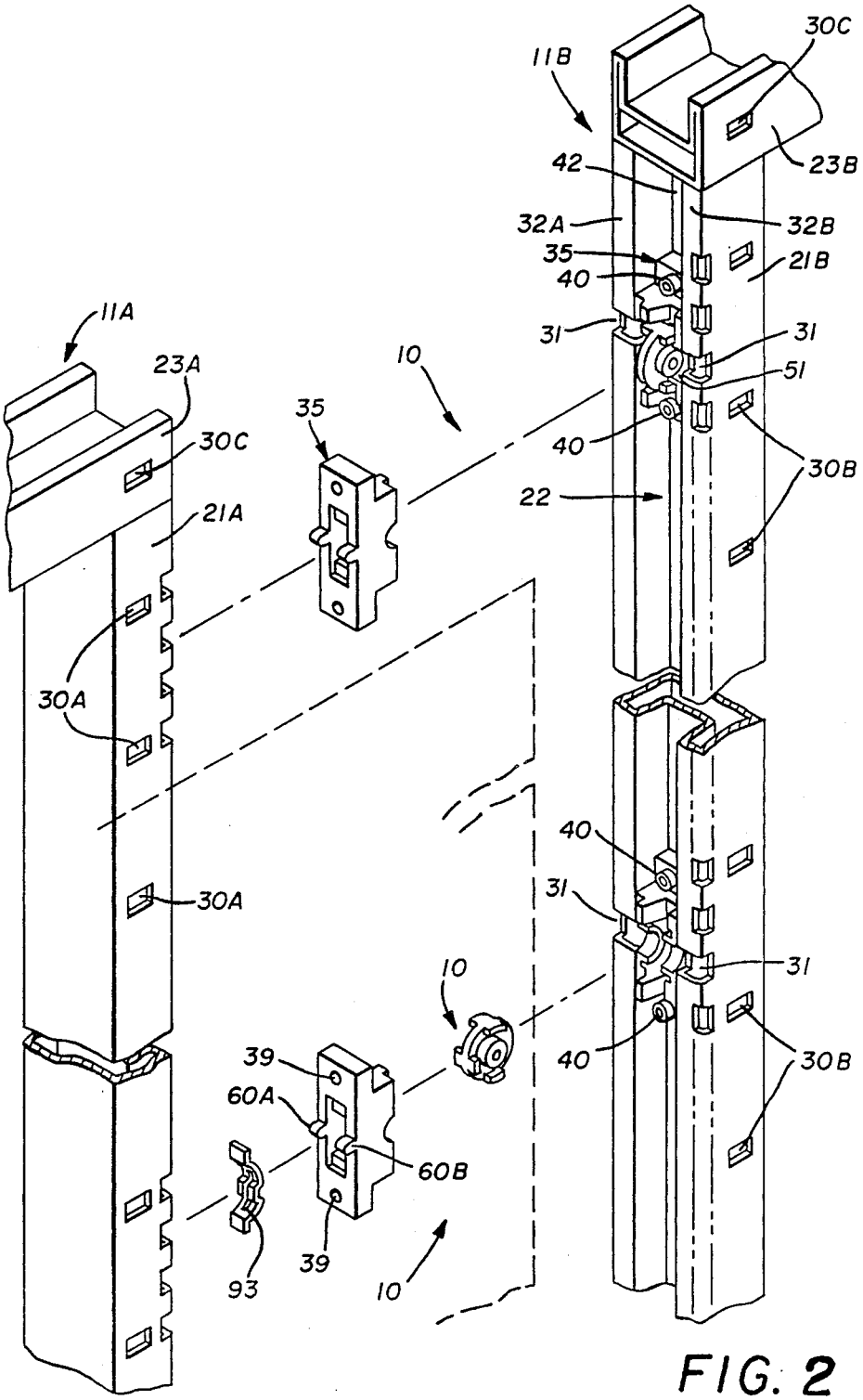
FIG. 2 is an enlarged, exploded perspective of a portion of FIG. 1 detailing an exemplary interconnecting structure embodying the concepts of the present invention and displayed for use in conjunction with appropriate portions of a relocatable wall.

FIGS. 1 and 2 depict exploded perspectives of a representative pair of linearly disposed wall panel assemblies 11A and 11B. The wall panel assemblies 11A and 11B have vertical frame members 21A and 21B on the opposed lateral edges thereof. Each vertical frame member 21 presents an outwardly facing, vertically oriented channel, or groove, 22 which preferably extends the full length of each vertical frame member 21. The vertical frame members 21 in each wall panel assembly 11 are secured to the top, or upper, horizontal frame members 23 as well as to the bottom, or lower, frame members 24. As best seen in FIG. 1, therefore, the frame member 21A extends vertically between the upper, horizontal frame member 23A and the lower, horizontal frame member 24B in wall panel assembly 11A. Similarly, the frame member 21B extends vertically between the upper, horizontal frame member 23B and the lower, horizontal frame member 24B in wall panel assembly 11B.

It may also be desirable to utilize a horizontally disposed, medial stringer 25 which extend between the vertical frame members 21. As such, a stringer 25A may extend horizontally between the vertical frame members 21A and 21C in wall panel assembly 11A, and a similar medial stringer 25B may be employed in wall panel assembly 11B. The upper frame members 23, the lower frame members 24 and the medial stringers 25 may, as depicted, all incorporate a channel-shaped race 26 which permits the convenient installation of electric and telephone lines as well as computer communication cables.

Before continuing with a description of the interconnecting structure 10 it should be explained that each wall panel assembly 11 may be provided with one or more foot and levelling mechanisms 27 which are designed to establish, and maintain, the adjacent wall panel assemblies 11 at a predetermined height above the floor, or the foot and levelling mechanisms 27 may be employed to establish a level orientation for the overall wall, regardless of the irregularities of the floor. A more detailed description of a representative foot and levelling mechanism 27 can be found in co-pending U.S. patent application Ser. No. 364261, also filed on June 9, 1989, and assigned to the assignee hereof.

A plurality of anchor slots 30 are spaced along selected structural members, such as the vertical frame members 21 and the upper frame member 23, which delineate the lateral and upper edges of the wall panel assemblies 11. As best seen in FIG. 2, a plurality of anchor slots 30A may be provided in the vertical frame member 21A, a plurality of anchor slots 30B may be similarly provided in vertical frame member 21B and comparable anchor slots 30C and 30D may be provided in the upper frame members 23A and 23B, respectively, of the wall panel assemblies 11A and 11B. The anchor slots 30 are adapted to secure the decorative panel coverings to the wall panel assemblies 11 in a manner well known to the art. The panel coverings are generally a fabric covered sheet which is removably secured to the frame. The fabric coverings may be added after the panel assemblies are secured together to form the relocatable wall. The fabric coverings can be changed after the wall is assembled for the purposes of redecorating, all as is well known to the art.

Access slots 31 are provided at predetermined locations along the length of each vertical frame member 21. The access slots 31 extend transversely throught the side flanges 32A and 32B—which define the sides of the vertical channels, or grooves, 22—to provide an opening through which an appropriate tool, as hereinafter discussed, can be inserted. The purpose for the tool will also be hereinafter explained in conjunction with the description relating to the operation of the interconnecting structure 10.

The vertical channels 22 are adapted to receive one or more cam key blocks 35, which are important components of the interconnecting structure 10. Each cam key block 35, which can be seen in FIGS. 1 and 2, but which are most clearly depicted in FIGS. 3, 4 and 5, has a main body portion 36 that is substantially rectangular in shape with a pair of support pads 38A and 38B that extend longitudinally outwardly from the body portion 36. Each support pad 38 has an opening 39 through which a fastening means 40 may be insertably received to secure the cam key blocks 35 within the groove 22 of each vertical frame member 21. In the preferred embodiment the fastening means 40 may comprise threaded devices which extends through the opening 39 in each support pad 38 threadably to engage the web portion 42 of the channel 22. It should be appreciated, however, that other securing devices, such as rivets, may be employed to secured the cam key blocks 35 within the channels 22 of the vertical frame members 21.

The body portion 36 of each cam key block 35 has a longitudinal axis 43, a laterally transverse axis 44 and a normal axis 45 which is perpendicular to the intersection of the longitudinal and the laterally transverse axes 43 and 44. A generally rectangular, central slot 46—which is elongate in the direction of the longitudinal axis 43 and relatively narrow in the direction of the laterally transverse axis 44—extends parallel to the normal axis 45 to penetrate the body portion 36 of the cam key block 35. By penetrating the body portion 36 the central slot 46 opens through the obverse face 48 as well as the reverse face 49 of the body portion 36. The obverse face 48 lies in a plane which includes the laterally transverse axis 44, and the reverse face 49 is disposed in a plane that is parallel to, and displaced from, the obverse face 48. When the cam key block 35 is secured within a channel 22 the reverse face 49 engages the web portion 42 of the channel 22.

A pair of semi-cylindrical bearing surfaces 50A and 50B are recessed into the obverse face 48, and are disposed concentrically about the laterally transverse axis 44. The recessed area that is partially surrounded by each bearing surface 50 in the body portion 36 comprises an opening 51 to permit access to the hereinafter described mechanism that is received within the central slot 46 and journalled on the bearing surfaces 50. As such, the purpose of the access opening 51 will be more fully hereinafter described.

The opposite side walls 53A and 53B of the central slot 46 are interrupted by a pair of substantially semi-annular ribs 54A and 54B. The radially outer surfaces on the respective ribs 54A and 54B comprise cam surfaces 55A and 55B, and the radially inner surfaces are registered, and merge, with the respective semi-cylindrical bearing surfaces 50. Whereas the semi-cylindrical bearing surfaces 50 may be centered about the laterally transverse axis 44, the cam surfaces 55A and 55B, if acurate, would be preferably centered about an axis 56 which also intersects the normal axis 45 but which is offset from the laterally transverse axis 44 in the amount of a few thousandths of an inch, as represented at 58, in order to provide the necessary camming action from the surfaces 55A and 55B, as will hereinafter be more fully explained. It will also become apparent that the cam surfaces 55A and 55B may be somewhat elliptical, as depicted, to effect the desired result.

A pair of aligning protuberances 60A and 60B extend outward from the reverse face 49 of the body portion 38. The aligning protuberances 60 are adapted to be received in one of the aligning slots (FIG. 1) selected from the plurality thereof which are provided at predetermined locations along the web wall 42 of the channel 22. The engagement of the aligning protuberances 60 within the appropriate aligning slot 61 assures that each cam key block 35 is precisely disposed at the desired vertical location within the channel 22 of each vertical frame member 21, as necessary to assure the proper interaction between the cam key blocks 35 on opposed vertical frame members 21 of successively adjacent wall panel assemblies 11, as well as with the cam key blocks 35 on any post arrangement 20 interposed between converging wall panel assemblies.

As depicted in FIGS. 2 through 5, a pair of anchor recesses 62A and 62B may be provided in the reverse face 49 of each cam key block 35. The recesses 62 are disposed, or otherwise positioned, to accommodate the mounting tangs 63A and 63B, respectively, of the hereinafter more fully described spring detent member 64 which is individually depicted in FIG. 1.

A pair of saw-tooth, lateral locators 65 and 66 are longitudinally spaced, preferably at opposite ends of the obverse face 48. Each lateral locator 65 and 66 has a projecting, positioning lug 68 and a laterally adjacent positioning recess 69. As most clearly represented in FIGS. 3–5, the lugs 68A and 68B in the respective lateral locators 65 and 66 are located on the same lateral side of the longitudinal axis 43 but on longitudinally opposite sides of the laterally transverse axis 44. In fact, the positioning lugs may well be located adjacent the longitudinal ends of the central slot 46.

Figure 8:
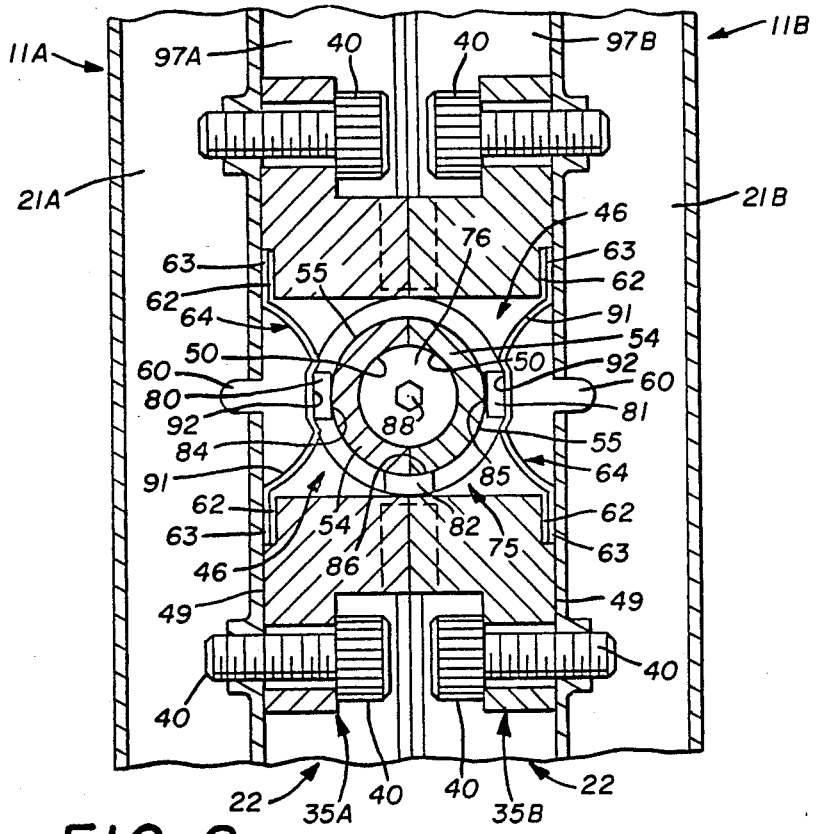
FIG. 8 is an enlarged, vertical section taken through an interlocking assembly of two cam key blocks and a cam key.

The positioning recesses 69A and 69B in the respective lateral locators 65 and 66 are located on laterally opposite sides of the longitudinal axis 43 from the lugs 68A and 68B and also on longitudinally opposite sides of the lateral axis 44. An inclined ramp 70A extends between the apex surface 71A of the positioning lug 68A and the floor 72A of the laterally adjacent positioning recess 69A. Similarly, an inclined ramp 70B extends between the apex surface 71B of the positioning lug 68B and the floor 72B of the laterally adjacent positioning recess 69B. The dimensions of the lugs 68 and recesses 69 in each lateral locator 65 and 66 are chosen such that when a cam key block 35A is brought into abutting engagement with an opposed cam key block 35B, as depicted in FIG. 8, the positioning lugs 68 on cam key block 35A will be snugly received within the opposed positioning recesses 69 in cam key block 35B, with the inclined ramps 70 on the opposed cam key blocks 35A and 35B lying in contiguous juxtaposition. Similarly, the laterally outwardly disposed side walls 73A and 73B on each positioning lug 68A and 68B will be engaged with the oppositely facing, laterally outwardly disposed side walls 74A and 74B of the positioning recesses 69A and 69B within which the lugs 68A and 68B are received.

As such, the various surfaces of the lateral locators 65 and 66 effect, and maintain, lateral alignment between opposedly interfitted cam key blocks 35. Specifically, the configuration of the lateral locators 65 and 66 permits the lateral locators 65 and 66 on opposed cam key blocks 35 to interfit in such a way as to guide opposed cam key blocks 35 into an aligned disposition and to secure the interfitting cam key blocks 35 in their aligned disposition. Hence, when the opposed cam key blocks 35A and 35B are secured to successively adjacent wall panel assemblies 11A and 11B, as depicted in FIG. 8, and when those wall panel assemblies are brought together in a linear intersection 12, as depicted in FIG. 15, the lateral locators 65 and 66 on the opposed, interfitting cam key blocks 35 will secure the wall panel assemblies 11A and 11B against undesired lateral displacement.

Figure 6:
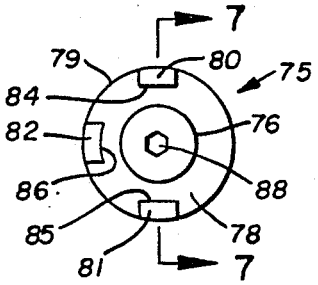
FIG. 6 is a frontal elevation view of a cam key adapted for use with any cam key block embodying the concepts of the present invention.
Figure 7:
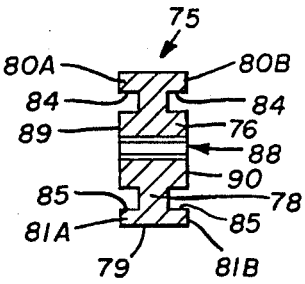
FIG. 7 is a vertical cross section taken substantially along line 7—7 of FIG. 6.

FIGS. 6 and 7 depict a representative cam key 75 that is adapted to secure opposedly aligned, and interfitted, cam key blocks 35 not only against longitudinal separation but also to bring, and maintain, the obverse faces 49 on the opposed cam key blocks 35 into firm engagement. As seen in FIGS. 1, 6 and 7, the cam key 75 has a central hub portion 76 which serves as a journal. A disk portion 78 extends radially outwardly from the axially medial portion of the hub 76. The disk portion 78 has a cylindrical outer surface 79, and a plurality of locking bolts extend axially outwardly from the disk portion 78, preferably in proximity to the cylindrical outer surface 79 thereof. First and second pairs of locking bolts 80 and 81, respectively, extend axially outwardly from the disk portion 78 in diametric opposition, and a pair of retaining bolts 82 is located at substantially 90° (FIG. 6) from both the first and second pairs of locking bolts 80 and 81. As such, there is an approximately 180° span along the circumference of the disk portion 78 which has no bolts, either locking or retaining.

Each pair of locking bolts 80 and 81, as well as the pair of retaining bolts 82, may have an outer, cylindrical surface which merges with, and is a part of, the cylindrical surface 79 on the disk portion 78. The pairs of locking bolts 80 and 81 have radially inner, locking surfaces 84 and 85, respectively. The locking surfaces 84 and 85 are preferably planar, as depicted in FIG. 6, and/or the reason for using planar locking surfaces 84 and 85 will be hereinafter more fully explained. The engaging surfaces 86 on the pair of retaining bolts 82 may, however, be arcuate, also be depicted in FIG. 6.

A tool engaging aperture 88 is provided in at least one of the end walls 89 and 90 on the central hub portion 76, and, as shown, the aperture 88 may extend axially through the central hub 76. The tool engaging aperture 88 is shown as being hexagonal to accept a tool such as a hex-wrench or Allen wrench. If desired, however, the tool engaging aperture 88 could well be slotted to accept the blade of a standard screwdriver. In either event, acceptance of a tool within the tool engaging aperture 88 permits the cam key 75 to be selectively rotated, the necessity for which will hereinafter become more apparent.

FIG. 8 represents the interfitting engagement of two opposed cam key blocks 35A and 35B that are respectively secured to successively adjacent wall panel assemblies 11A and 11B in a linear intersection 12, as depicted in FIG. 15. Each cam key block 35 is secured within the vertical groove 22 of the opposed vertical frame members 21 in successively adjacent wall panel assemblies 11A and 11B by fastening means 40. It will be noted that when the cam key blocks are so secured, a spring detent member 64 is generally captured between the reverse face 49 on the body portion 36 of each cam key block 35 and the web portion 42 of the channel 22 within which the cam key block 35 is secured. Specifically, the mounting tangs 63 of the spring detent member 64 are received within the recesses 62, and the body portion 91 of the spring detent member 64 which extends between the tangs 63 bows outwardly and into the central slot 46 of the cam key block 35 which has so captured the spring detent member 64. A detent recess 92 is disposed medially of the bowed body portion 91 releasably to engage the locking bolts 80 and 81 or, alternatively, as will be hereinafter explained, the retaining bolts 82. It should be noted that in order to engage the bolts 80 and 81, or 82, it is necessary for the bowed body portion 91 to be notched, as at 93 (FIG. 2), to preclude the cylindrical outer surface 79 on the disk portion 78 from preventing engagement between the detent recess 92 and the desired bolt 80, 81 or 82.

The cam key 75 is disposed within the central slots 46 of the opposed cam key blocks 35A and 35B such that the planar locking surfaces 84 and 85 on the first and second pairs of locking bolts 80 and 81, respectively, engage the cam surfaces 55 on the ribs 54 which extend into the central slots 46 of the opposed cam key blocks 35A and 35B. That is, the pair of locking bolts 80 engage the cam surface 55 associated with the cam key block 35A secured to wall panel assembly 11A, and the pair of locking bolts 81 engage the cam surface 55 associated with the cam key block 35B secured to wall panel assembly 11B. The retaining surfaces 86 on the pair of retaining bolts 82 serve no present purpose and are, therefore, disposed to be substantially centrally aligned on the concurrent longitudinal axes 43 of the conjoined cam key blocks 35.

The planar locking surfaces 84 and 85 are disposed substantially tangential to the cam surfaces 55, and as previously noted, the dimensions and/or configuration of the cam surfaces 55 are such as to permit the planar locking surfaces 84 and 85 to draw the two, successively adjacent wall panel assemblies 11A and 11B into firm end-to-end engagement. The arcuate surface 86 need not firmly engage the cam surfaces 55, and the surface 86 may, therefore, have an arcuate dimension that is somewhat larger that the arcuate dimension of the cam surfaces 55.

As should now be understood, two opposedly aligned, and interfitted, cam key blocks 35A and 35B are held firmly together by a cam key 75. The use of four cam key blocks 35 located in vertically spaced pairs are generally sufficient to secure a linear intersection 12 for most reasonable wall heights.

To secure, or release, successively adjacent wall panel assemblies 11 by use of the interconnecting structure 10 is a straight forward operation. For example, to begin with the release operation one can continue to refer to FIG. 8, and it will be observed that a workman need only insert a tool (not shown) having the appropriate configuration between the decorative panels coverings 97A and 97B which are mounted to, and are a part of, the respective wall panel assemblies 11A and 11B. The tool can pass into the access opening 51 (FIGS. 2 and 3) provided between the abutting cam key blocks 35A and 35B to engage the mating configuration of the aperture 88. Thereafter rotation of the tool through 90° (in either direction) forces the pair of locking bolts 80 to overcome the pressure applied by the detent recess 92 in the bowed body portion 91 of the spring detent member 64 held by cam key block 35A. At the same time the rotative force causes the locking bolts 81 similarly to overcome the pressure applied by the detent recess 92 in the spring detent member 64 held by the cam key block 35B. After the cam key 75 has been rotated through 90° the retaining bolts 82 snap into the detent recess 92 associated with one of the cam key blocks 35A or 35B. This engagement of the retaining bolt 82 with the detent recess 92 provides the workman with both a tactile indication (a sudden release of the rotative force followed immediately by an increase in the rotative resistance) and an aural indication, as the spring detent member 64 snaps the detent recess 92 into engagement with the pair of retaining bolts 82. When all the interconnecting structures 10 which secured the two successively adjacent wall panel assemblies 11A and 11B together have been thus released, the wall panel assemblies 11A and 11B can be translated linearly apart to release the two cam key blocks 35A and 35B.

Each cam key 75 will remain within only one of the cam key blocks 35—viz., that cam key block 35 which is engaged by the retaining bolts 82. Because approximately 180° of the cylindrical outer surface 79 on the cam key 75 opposite the retaining bolt 82 has no locking, or retaining, bolt, there is nothing to restrict separation of the cam key blocks 35 in the direction of the normal axis 45. This separation of the opposed cam key blocks 35 is further assured by virtue of the fact that the locking surfaces 84 and 85 are planar, and tangential to the cam surface 55. As such, that is no restraining interaction between the cam key blocks 35, and the cam key 75, to preclude the desired separation.

Even after the cam key blocks 35A and 35B are fully separated, the cam key 75 will remain secured within one of the cam key blocks 35, unless one rotates the cam key 75 through 180° after the cam key blocks 35 have been separated. Such rotation of the cam key 75 would position the retaining bolts 82 exteriorly of the cam key block 35 and position the locking bolts 80 and 81 such that they can be translated past the ribs 54, out of engagement with the cam surfaces 55. Of course, simply leaving the cam key 75 in situ may facilitate the joinder of that wall panel assembly to a successive wall panel assembly.

Effecting a joinder of a wall panel assembly 11B to another wall panel assembly 11A in a linear intersection 12 is simply accomplished be reversing the procedure previously explained to separate the wall panel assemblies 11A and 11B from the intersection 12. Joinder, however, cam be more readily accomplished by including certain dimensional, or space, tolerances which tend to facilitate insertion of the cam key 75—which has already been received in one cam key block 35—into the central slot 76 of the opposed cam key block 35. The most difficult aspect of inserting the cam key 75 is to have the pairs of locking bolts 80 and 81 enter the central slot 76. This difficulty is compounded when there are two, vertically spaced, opposed pairs of cam key blocks 35 into which two cam keys 75 must be simultaneously inserted. It has been found, however, that such difficulty can be obviated by utilizing two structural accommodations—viz: (1) make the locking surfaces 84 and 85 planar, which, in conjunction with the use of an elliptic configuration for the cam surfaces 55 provides clearance between the radially inner locking surfaces 84 and 85 and the termini 94A and 94B of the rib 55A and the termini 95A and 95B of the rib 55B along which the cam surfaces 55 are presented; and, (2) extending the dimension of the central slot 46 along the longitudinal axis 43 to provide a modest clearance between the cylindrical outer surface 79 on the cam key 79 and the longitudinal end walls 96 and 98 (FIG. 4) of the central slot 76.

There are, of course, a number of ways in which the dimensional clearances can be increased, or enlarged, to provide the desired result. As an alternative to increasing the overall longitudinal dimension of the central slot 76, for example, one might provide a rectangular entry step in the end walls 96 and 98 of the central slot 76, or the end walls 96 and 98 can be formed to provide an obliquely flared opening through the obverse face 48. What should be appreciated at this point is that the size of the central slot 76 which opens through the obverse face 48 affects the ease with which the adjacent panels can be joined without undue hardship. However, there is no reason, or advantage, to make the opening larger than necessary.

In any event, once the cam keys 75 have been received within the central slots 76 of the opposed cam key blocks 35A and 35B, and the obverse face 48 on each are abuttingly opposed, the cam keys 75 are rotated 90° in either direction to achieve the position depicted in FIG. 8. Here, too, the engagement of the pairs of locking bolts 80 and 81 within the detent recesses 92 will provide the same tactile and aural signal that the wall panel assemblies have been secured, one to the other, through the interconnecting structure 10 in an aligned intersection 12.

Figure 10:
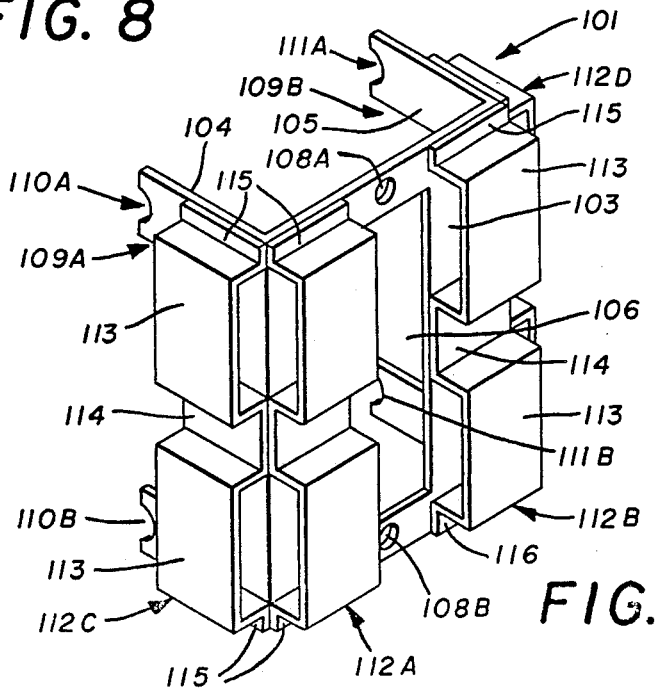
FIG. 10 is a perspective veiw of one half a gusset assembly used to install one or more cam key blocks to a square post member, as shown in FIG. 9, said FIG. 10 appearing on the same sheet of drawings as FIG. 8.
Figure 9:
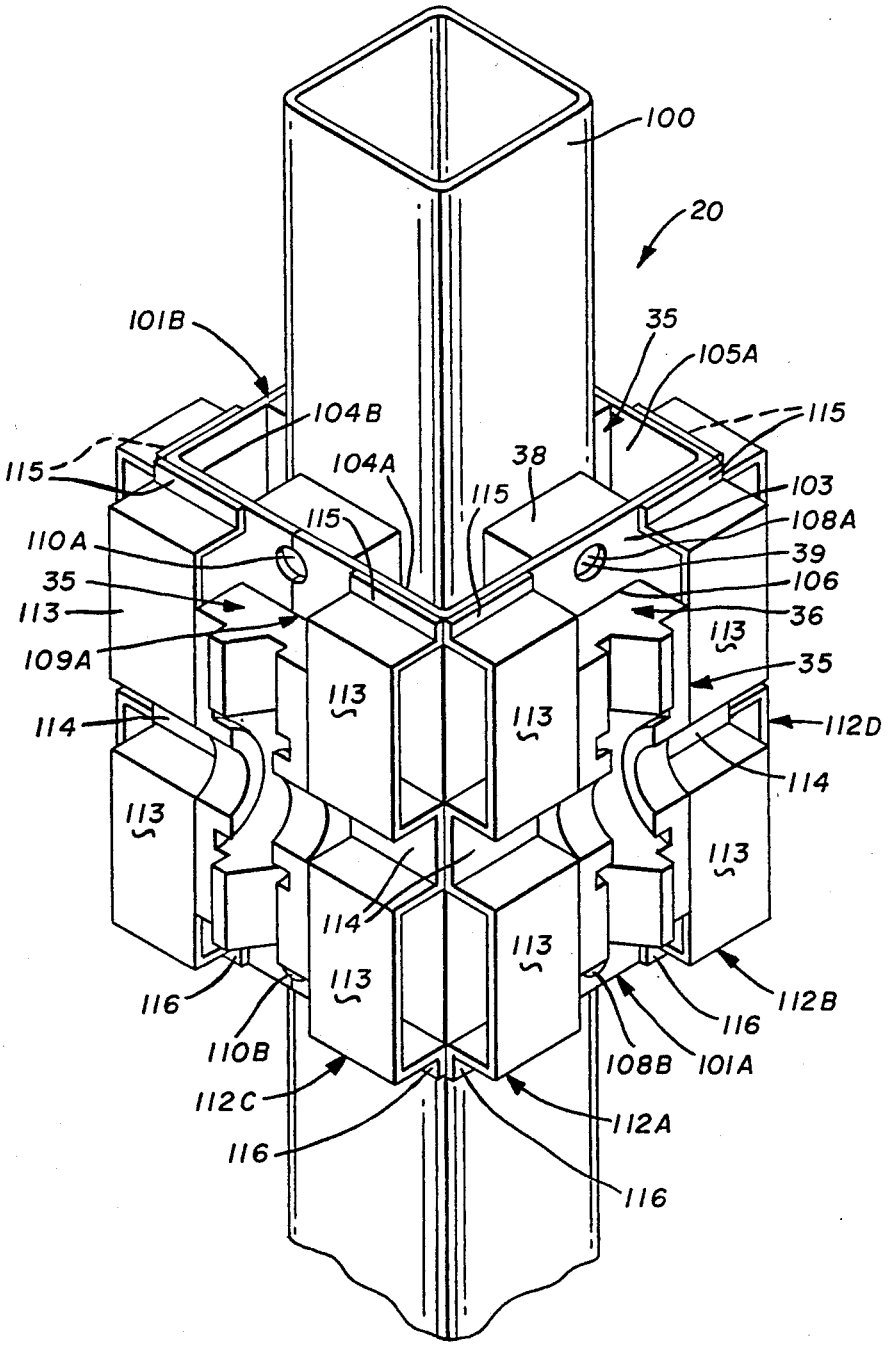
FIG. 9 is a perspective view of a square post member having four cam key blocks and associated gusset assembly installed thereon.

To provide an L-intersection 13, a T-intersection 14 or an X-intersection 15, one preferably utilizes a post arrangement 20. The pertinent details of a post arrangement 20 are best seen in FIG. 9, with a sub-assembly depicted in FIG. 10. Each post arrangement 20 will also provide the desired vertically spaced disposition of the cam key blocks 35 heretofore discussed with respect to the linear intersection 12. However, in order to achieve a connection between converging wall panel assemblies, as distinct from successively adjacent, linearly disposed, wall panel assemblies, the converging wall panel assemblies are each secured to a post arrangement 20 by virtue of the novel interconnecting structure 10, and in the same manner as previously discussed with respect to the linear intersection 12.

With respect to the structural details of each post arrangement 20, then, a pair of unique structural components have been provided to secure the requisite number of cam key blocks 35 to the typical square post member 100 utilized in each post arrangement 20. As seen in FIG. 9, each post member 100 has between two and four cam key blocks 35 secured thereto at each predetermined, vertical level. As should be apparent from FIGS. 9 and 11 through 13, the number of sets of cam key blocks 35 installed on each post member 100 is determined by the number of wall panels assemblies 11 converging on the resulting post arrangement 20. The necessary cam key blocks 35 are secured to the post member 100 by fasteners, such as those previously identified by the numeral 40 (not depicted in FIGS. 9 or 10, but their locations are hereinafter described in considerable detail) in a manner similar to that used to secure the cam key blocks 35 into the groove 22 of the vertical frame member 21. In addition, however, each cam key block 35 is surrounded by a gusset assembly 101 such as that shown in FIG. 10.

Each gusset assembly 101 preferably employs a U-shaped bracket 102. Each U-shaped bracket 102 has one full face 103 and two, half-sides, or arms, 104 and 105. The full face 103 has a rectangular aperture 106 and two circular apertures 108A and 108B. The rectangular aperture 106 circumscribes that portion of the body 36 on a cam key block 35 which extends outwardly of the support pads 38, and the circular apertures 108A and 108B register with the openings 39 through the two support pads 38 on the cam key block 35.

The half-sides, or arms, 104 and 105 extend substantially perpendicularly outwardly from the lateral edges of the full face 103. The arm 104 terminates in a rectangular recess 109A and two semi-circular recesses 110A and 110B. Similarly, the arm 105 terminates in a rectangular recess 109B and two, semi-circular recesses 111A and 111B. As can be readily observed, the rectangular recesses 109A and 109B each comprise one half of a rectangular aperture similar to that specifically identified at 106 in the full face 103, and the semi-circular recesses 110 and 111 each comprise one half of the corresponding circular apertures 108A and 108B.

Accordingly, when two gusset assemblies 101A and 101B are mounted in opposition about a square post member 100 (FIG. 9), the opposing side arms 104A and 104B as well as 105A and 105B complement each other to duplicate full faces 103. Hence, the two gusset assemblies 101A and 101B provide an identically configured, and disposed, rectangular aperture and circular apertures on all four sides of the resulting post arrangement 20. As such, a cam key block 35 can be secured on each side of the post arrangement 20 by the use of fasteners which pass through the circular apertures in the appropriate gusset assembly 101 and the registered openings 39 through the support pads 38 in order to anchor the cam key blocks 35, and the gusset assemblies 101 which embrace the cam key blocks 35, to the square post member 100.

A pair of spacer brackets 112A and 112B are included in each gusset assembly 101 and are disposed, one on either side of each rectangular aperture 105, a third spacer bracket 112C is secured to the side arm 104, adjacent the rectangular recess 109A therein, and a fourth spacer bracket 112D is secured to the side arm 105, adjacent the recess 109B therein. The spacer brackets 112 all present a raised surface 113, each raised surface 113 simulating one of the side flanges 32 in the vertical frame members 21. Each spacer bracket 112 also incorporates an offset recess 114 which simulates one of the access slots 31 in each side flange 32. The spacer brackets 112 may be tack welded, or otherwise secured, to the U-shaped bracket 102 of the appropriate gusset assembly 101. Tack welding may be conveniently accomplished where the mounting tabs 115 and 116 at each end of the spacer bracket 112 engage the full face 103 of the bracket 102 in gusset assembly 101 as well as where the offset recess 114 engages the bracket 102.

Figure 11:
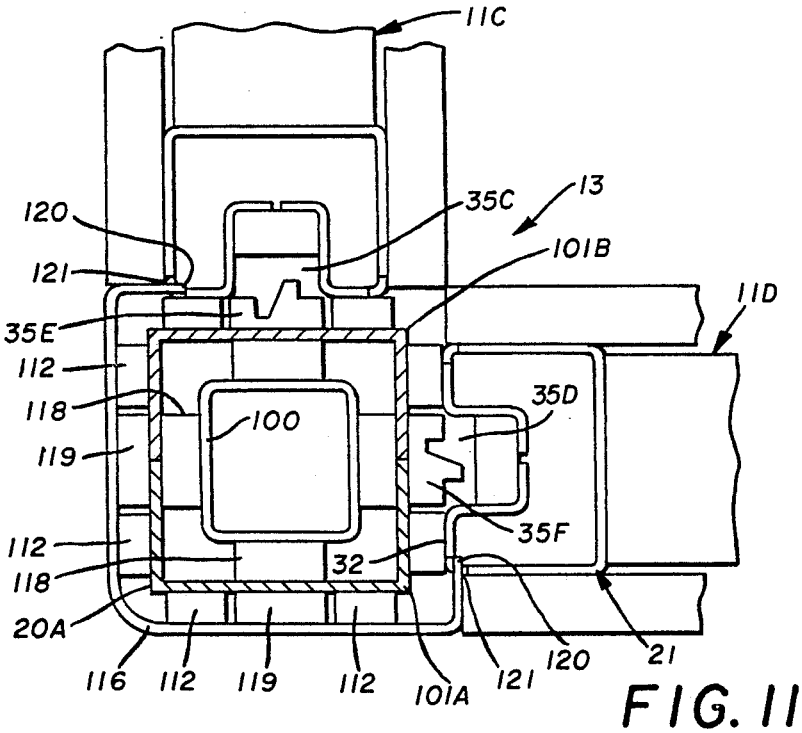
FIG. 11 is a horizontal section of a two panel, corner post assembly generally identified as an L-intersection.
Figure 12:
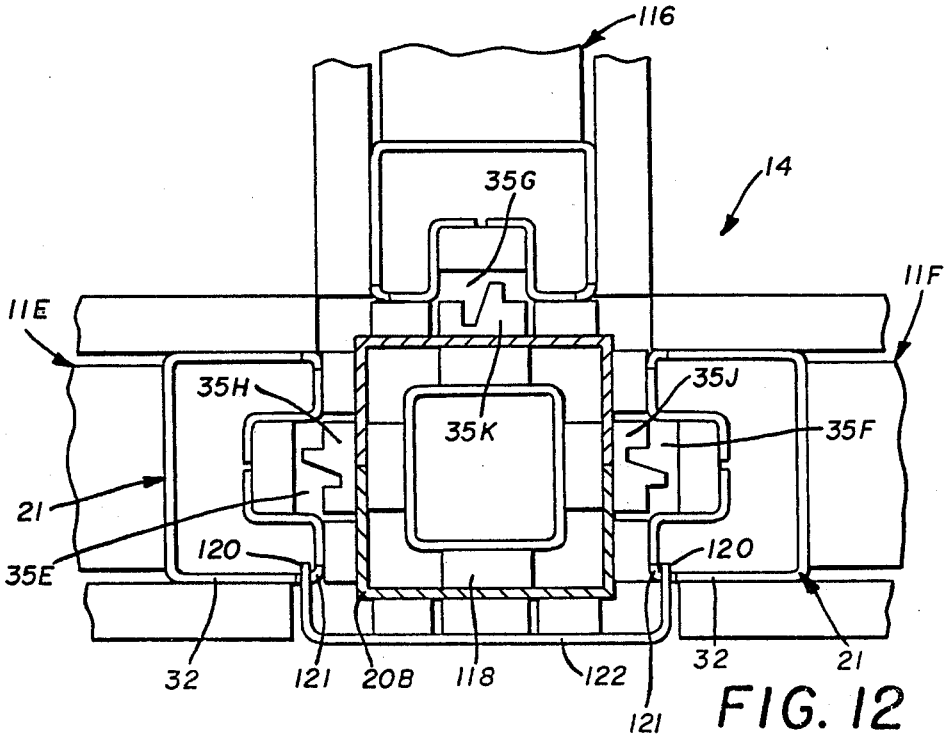
FIG. 12 is a horizontal section, similar to FIG. 11, but depicting a three panel post assembly as employed at a T-intersection.
Figure 13:
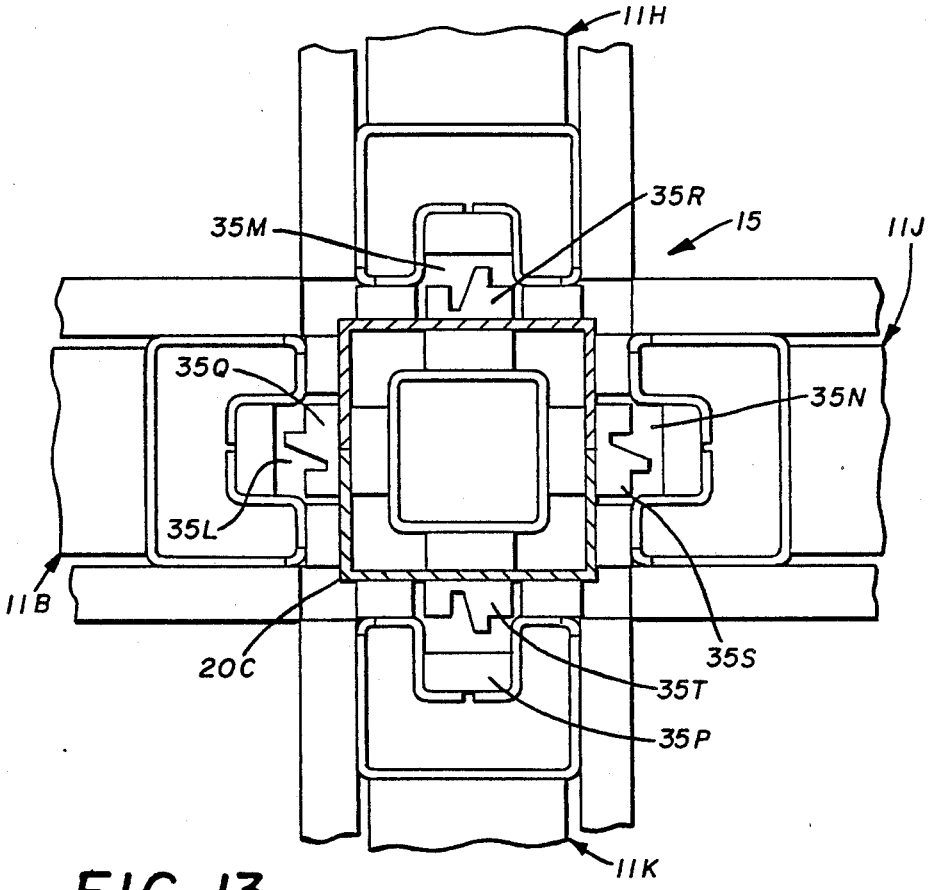
FIG. 13 is a horizontal section of a four panel post assembly as employed at an X-intersection.

FIGS. 11 through 13 represent the three most common uses for the post arrangement 20. FIG. 11 represents a two panel corner configuration, sometimes identified as an L-intersection 13. In an L-intersection 13 the post arrangement 20A has two wall panel assemblies 11C and 11D secured thereto in a manner similar to that described in conjunction with FIG. 8. That is, a cam key (not shown) is used to secure the cam key blocks 35C and 35D on the converging wall panel assemblies 11C and 11D to the opposing cam key block 35E and 35F on the post arrangement 20A.

As explained in conjunction with the joinder of two successively adjacent wall panel assemblies 11A and 11B (FIG. 8) the use of cam key blocks 35 at two vertically space locations is generally all that is required to effect a most satisfactory joinder. Similarly, the same number is all that should normally be required to secure converging wall panel assemblies together through the intercession of a post arrangement 20.

At those locations about the periphery of the post arrangement 20A where no cam key blocks need be employed, because no wall panel assemblies are present, a cap may be installed to provide a decorative cover. In the L-intersection 13 a two-wall cap 116 is used to cover the spacer brackets 112 on the two otherwise exposed surfaces of the post arrangement 20. A pair of rectangular filler blocks 118 may be employed with the two-wall cap 116. The filler blocks have outer end dimensions substantially equal to the support pads 38 to prevent the fasteners from causing the gusset assemblies 101 to collapse. IF desired, the filler blocks 118 may be provided with a central pillar potion 119 which has a dimension substantially equal to the height of the spacer brackets 112 to assist in supporting the two-wall cap 116. As should now be apparent, the two-wall cap 116 is installed to provide a decorative cover over those spacer brackets 112 which do not surround a cam key block 35. The two-wall cap 116 may have a plurality of fingers 120 along each lateral edge which are received within the edge slots 121 provided along the outer edges of the side flanges 32 of the vertical frame members 21.

The post arrangement 20B shown in FIG. 12, provides for a three panel, T-intersection 14. In a T-intersection 14 the post arrangement 20B has three wall panel assemblies 11E, 11F and 11G secured thereto, also in a manner similar to that described in conjunction with FIG. 8. That is, a cam key (not shown) is used to secure the cam key blocks 35E, 35F and 35G on the converging wall panel assemblies 11E, 11F and 11G to the opposing cam key block 35H, 35J and 35K on the post arrangement 20B. In the T-intersection arrangement 14, only one filler block 118 need be used. This filler block 118 is covered by a decorative one-wall cap 122. In this configuration the one-wall cap 122 is also provided with fingers 120 along each lateral edge which are received within the edge slots 121 provided along the outer edges of the side flanges 32 of the vertical frame members 21.

The post arrangement 20C shown in FIG. 13, provides for a four panel, X-intersection 15. In an X-intersection 15 the post arrangement 20C has four wall panel assemblies 11B, 11H, 11J and 11K secured thereto, also in a manner similar to that described in conjunction with FIG. 8. That is, a cam key (not shown) is used to secure the cam key blocks 35L, 35M, 35N and 35P on the converging wall panel assemblies 11B, 11H, 11J and 11K to the opposing cam key blocks 35Q, 35R, 35S and 35T on the post arrangement 20C. In the X-intersection arrangement 15 no filler blocks 118 nor caps are required inasmuch as a wall pane assembly is attached to all sides of the post arrangement 20C.

Figure 5:
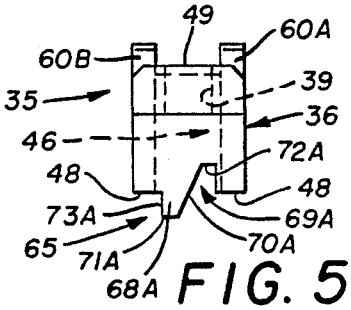
FIG. 5 is an end elevation of the cam key block depicted in FIGS. 3 and 4.
Figure 3:
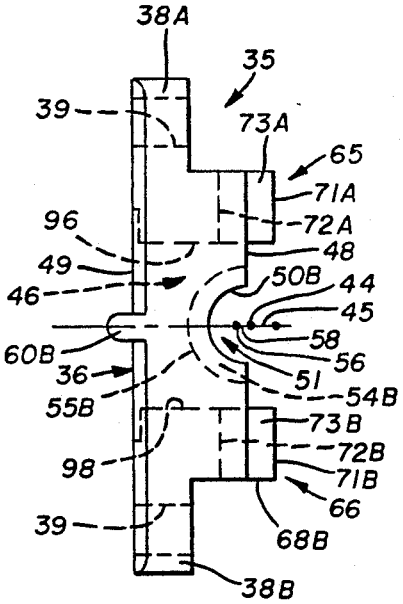
FIG. 3 is a further enlarged side elevational view of a representative cam key block, as depicted in FIGS. 1 and 2.
Figure 4:
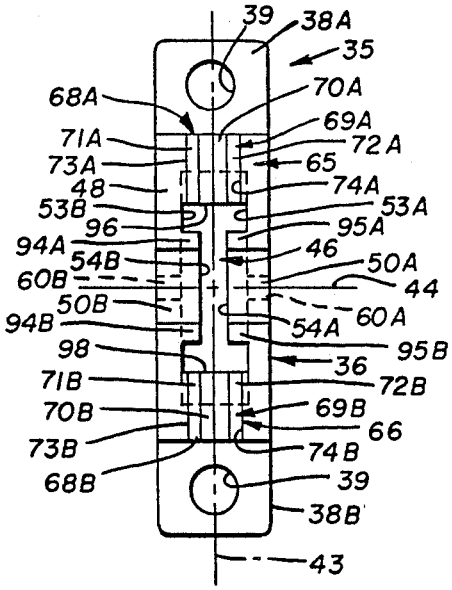
FIG. 4 is a frontal elevation of the cam key block depicted in FIG. 3.
Figure 14:
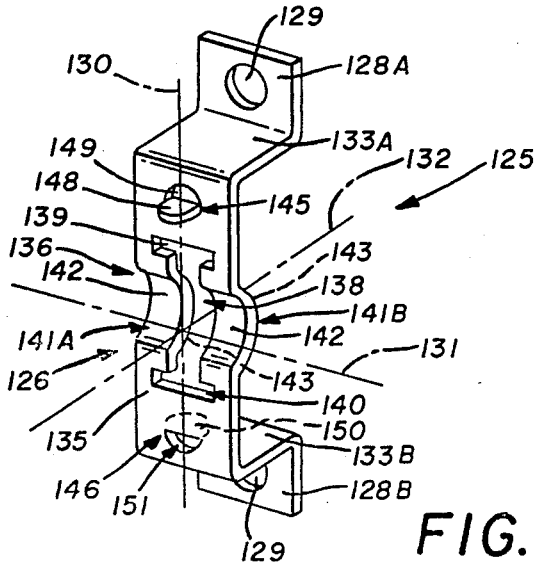
FIG. 14 is a perspective view of an alternate embodiment of a cam key block.

FIG. 14 depicts an alternative arrangement for a cam key block, identified generally by the numeral 125. The cam key block 35 heretofore described in conjunction with FIGS. 3–5 is preferably a sintered metal part. Such parts can be made with considerable strength while the dimensions of the part can be held close such that machining is not required. The alternative embodiment of a cam key block 125 is a stamped metal part which can generally be made for less cost.

The alternative form of the cam key block 125 has a body portion 126, and a pair of support pads 128A and 128B extend longitudinally outwardly from the body portion 126. Each support pad 128 has an opening 129 through which a fastener means (not shown) may be insertably received to secured the cam key block 125 in the selected location. The body portion 126 has a longitudinal axis 130, a laterally transverse axis 131 and a normal axis 132.

The body portion 126 includes a pair of legs 133A and 133B which are disposed parallel to the normal axis 132 and which extend upwardly from the support pads 128A and 128B, respectively, to merge with a bridge portion 135 which spans between the upper extremities of the legs 133A and 133B. The bridge portion 135 lies substantially within the plane defined by the longitudinal and the laterally transverse axes 130 and 131.

The medial portion of the bridge portion 135 has a substantially semicylindrical deflection 136 which is generally concentric about the laterally transverse axis 131. A central slot 138, which is elongate in the direction of the longitudinal axis 130 but relatively narrow in the direction of the laterally transverse axis 131, penetrates the deflection 136 and that part of the bridge portion 135 longitudinally adjacent the deflection 136. The longitudinal ends of the central slot 138 are defined by cross slots 139 and 140 which are elongate in the direction of the laterally transverse axis 131.

By thus bifurcating at least the deflection 136, a pair of parallel, generally semi-annular ribs 141A and 141B are formed. The substantially semicylindrical faces of the ribs 141 comprise concave bearing surfaces 142, and the convex faces of the ribs 141 comprise cam surfaces 143. It will be noted that the ribs 141 need not be exactly semi-annular; a slightly elliptical configuration to the ribs 141 will not defeat their ability to allow the central hub 76 of the cam key 75 to be journalled on the concave bearing surfaces 142 and yet will permit the cam surfaces 143 to perform their function of forcing the locking bolts 80 and 81 to draw the opposed cam key blocks 125 into locking engagement.

Accordingly, a cam key can be insertably received within the central slot 138. The locking, and/or the retaining, bolts 80, 81 or 82 on the cam key 75 can pass through the cross slots 139 and 140 to permit the central hub 76 to be rotatably journalled on the bearing surfaces 142 and to permit the planar locking surfaces 84 and 85 on the locking bolts 80 and 81, as well as the arcuate retaining surface 86 on the retaining bolts 82, to engage the cam surfaces 143 on the ribs 141.

The body portion 126 also presents lateral locators 145 and 146. As depicted, the lateral locator 145 comprises a tab 148 that is struck from the bridge portion 135 to extend substantially perpendicularly outwardly with respect to the bridge portion 135, leaving an opening 149. The lateral locator 146 comprises a tab 150 that is struck from the bridge portion 135 to extend substantially perpendicularly inwardly with respect to the bridge portion 135, leaving an opening 151. The tab 148 in the first lateral locator 145 and the opening 151 in the second lateral locator 146 are positioned such that when two of the cam key blocks 125 are used in as an opposed pair, the tabs 148 will be aligned with openings 151. In such a situation the tabs 148 in the lateral locators 145 will be located in longitudinally adjacent juxtaposition with the tabs 150 in the lateral locators 146.

A further variation of the fundamental cam key block is the end cap clip, identified generally by the numeral 155 in FIG. 1, to secure a decorative end cap 156 to a wall panel assembly 11. The clip 155 has a virtually planar body portion 158 with a pair of modesty offset support pads 159A and 159B extending longitudinally outwardly from the body portion 158. Each support pad 159 may have an opening 157 through which a fastener means 40 may be insertably received to secure the clips 155 at selected locations along the decorative end cap 156. Or, the fastener means 40 may be received in the back of the decorative end cap 156, with the head portion of the fastener means 40 overlying the pads 159 to hold the clip 155 in place.

The body portion 158 has a shallow V-notch 160 which is generally centered along the longitudinal extent of the body portion 158. A elongate central slot 161 penetrates the V-notch 160 and that part of the body portion 158 longitudinally adjacent the V-notch 160. The longitudinal ends of the central slot 161 are defined by cross slots 162 and 163. By thus bifurcating at least the V-notch 160, a pair of parallel, V-shaped ribs 165A and 165B are formed. The faces on either side of the interior angle of the ribs 165 comprise bearing surfaces 166, and the faces on either side of the exterior angle of the ribs 165 comprise cam surfaces 168. It will be understood that the central hub 76 of the cam key 75 rotatably engages the bearing surfaces 166 so that the cam surfaces 168 force the locking bolts 80 and 81 to draw the cam key block 155 into abutment with an opposed cam key block 35 mounted on the vertical frame member 21 of a wall panel assembly 11, thereby providing a convenient adaptation of the present invention for mounting the decorative end cap 156.

It should be understood that the cam key block 35 allows the user to effect selective connection between successive wall panel assemblies 11. That is, the orientation of the cam key block 35 on the frame member 21 will determine whether or not an opposed cam key block 35 will properly mate to effect a joinder between successive wall panel assemblies 11. This result obtains because the lateral locators 65 and 66 are both on the same side of the longitudinal axis 43. Hence, by simply effecting an appropriate top-to-bottom disposition of the cam key blocks 35 one can predetermine which lateral edges can be matingly engaged and which cannot. Thus, should one wish to be certain that only selected lateral edges on any two wall panel assemblies be capable of joinder, the appropriate top-to-bottom disposition of the cam key blocks will cause the projecting lugs 68 on the cam key block 35 secured to one wall panel assembly to mate with the lateral recesses 69 on the cam key block 35 in the opposed wall panel assembly 11, but a simple top-to-bottom inversion of one cam key block 35 will locate the projecting lugs 68 on the opposed cam key blocks 35 in such a disposition that they cannot matingly engage the recesses 69 on the opposed cam key block 35; rather, the projecting lugs 68 will abut each other and thereby preclude joinder.

Figure 18:
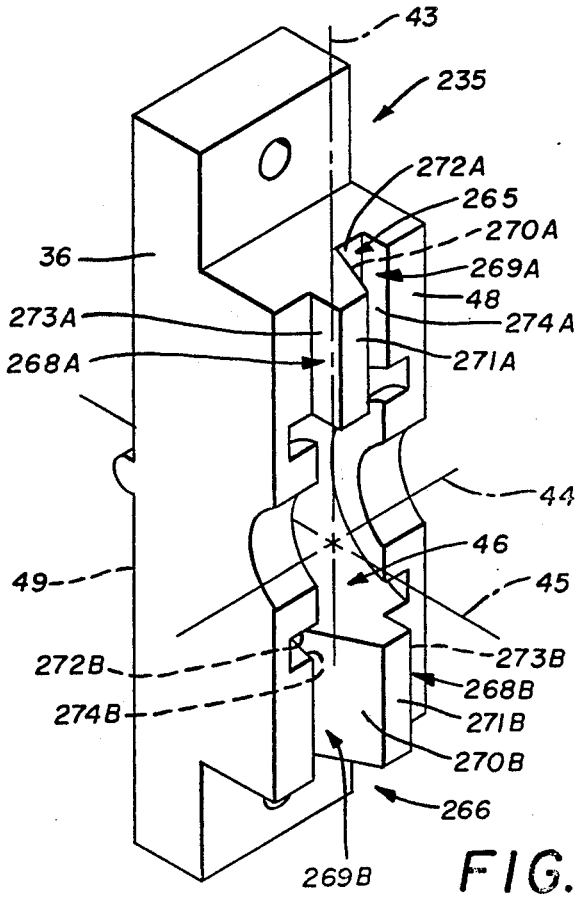
FIG. 18 is an enlarged perspective of a further alternative embodiment of a cam key block.

On the other hand, should one wish to accommodate universality so that opposing cam key blocks will matingly engage without regard to their top-to-bottom disposition on the opposed wall panel assemblies, the cam key blocks can incorporate the configuration identified by the numeral 235 in FIG. 18.

The only difference between the alternative form of the cam key blocks 35 and 235 relates to the disposition of the saw tooth lateral locators 265 and 266. Hence, all components of the cam key block 235 which are identical to the cam key block 35 will be identified in FIG. 18 with the same numeral used to identify those same parts on cam key block 35. To the contrary, all parts that are different, or differently disposed, will be prefixed by the numeral "2".

With reference, then, to FIG. 18 the body portion 36 of each cam key block 235 has a longitudinal axis 43, a laterally transverse axis 44 and a normal axis 45 which is perpendicular to the intersection of the longitudinal and the laterally transverse axes 43 and 44. A generally rectangular, central slot 46—which is elongate in the direction of the longitudinal axis 43 and relatively narrow in the direction of the laterally transverse axis 44—extends parallel to the normal axis 45 to penetrate the body portion 36 of the cam key block 235. By penetrating the body portion 36 the central slot 46 opens through the obverse face 48 as well as the reverse face 49 of the body portion 36. The obverse face 48 lies in a plane which includes the laterally transverse axis 44, and the reverse face 49, is disposed in a plane that is parallel to, and displaced from, the obverse face 48. When the cam key block 235 is secured within a channel 22 the reverse face 49 engages the web portion 42 of the channel 22.

A pair of saw-tooth, lateral locators 265 and 266 are longitudinally spaced, preferably at opposite ends of the obverse face 48. Each lateral locator 265 and 266 has a projecting, positioning lug 268 and a laterally adjacent positioning recess 269. As represented in FIG. 18, the lugs 268A and 268B in the respective lateral locators 265 and 266 are located on opposite sides of the longitudinal axis 43 as well as on longitudinally opposite sides of the laterally traverse axis 44. Here, too, the positioning lugs 268A and 268B may well be located adjacent the longitudinal ends of the central slot 46.

The positioning recesses 269A and 269B in the respective lateral locators 265 and 266 are located on laterally opposite sides of the longitudinal axis 43 from the lugs 268A and 268B and therefor also on laterally opposite sides of the longitudinal axis 43 from each other. As with the positioning lugs 268A and 268B, the positioning recesses 269A and 268B are on longitudinally opposite sides of the lateral axis 44.

An inclined ramp 270A extends between the apex surface 271A of the positioning lug 268A and the floor 272A of the laterally adjacent positioning recess 269A. Similarly, an inclined ramp 270B extends between the apex surface 271B of the positioning lug 268B and the floor 272B of the laterally adjacent positioning recess 269B. The dimensions of the lugs 268 and recess 269 in each lateral locator 265 and 266 are chosen such that when cam key blocks 235 are brought into abutting engagement, the positioning lugs 268 on each cam key block 235 will be snugly received within the opposed positioning recesses 269 in the opposed cam key block 235, with the inclined ramps 270 on the opposed cam key blocks 235 lying in contiguous juxtaposition. Similarly, the laterally outwardly disposed side walls 273A and 273B on each positioning lug 268A and 268B will be engaged with the oppositely facing, laterally outwardly disposed side walls 274A and 274B of the positioning recesses 269A and 269B within the lugs 268A and 268B are received.

As such, the various surfaces of the lateral locators 265 and 266 effect, and maintain, lateral alignment between opposedly interfitted cam key blocks 235. Specifically, the configuration of the lateral locators 265 and 266 permits the lateral locators 265 and 266 on opposed cam key blocks 235 to interfit in such a way as to guide opposed cam key blocks 235 into an aligned disposition and to secure the interfitting cam key blocks 235 in their aligned disposition, irrespective of the top-to-bottom disposition of the cam key blocks 235. Hence, when opposed cam key blocks 235 are secured to successively adjacent wall panel assemblies 11, and when those wall panel assemblies are brought together in a linear intersection 12, the lateral locators 265 and 266 on the opposed, interfitting cam key blocks 235 will secure the wall panel assemblies 11 against undesired lateral displacement.

Obviously many modifications and variations of the present invention are possible in light of the forgoing description. As should, therefore, now be apparent, the present invention not only teaches that an interconnecting structure which embodies the concepts of the present invention not only accomplishes structural integrity to the wall panel assemblies connected thereby but also otherwise accomplishes the remaining objects of the invention.

I claim:

1. An interconnecting structure for joining wall panel assemblies in a relocatable wall, said interconnecting structure comprising:

cam key block means;

cam surfaces formed on said cam key block means;

cam key means having a disk portion;

at least two locking bolt means extending transversely outwardly from said disk portion, said locking bolt means being disposed in diametric opposition;

said locking bolt means being complementary to said cam surfaces on said cam key block means;

said cam key means being rotatable with respect to said cam key block means selectively to position said locking bolt means in engagement with the cam surfaces on said cam key block means.

2. An interconnecting structure, as set forth in claim 1, further comprising:

lateral locator means presented from said cam key block means;

said cam key block means being adapted to be disposed in opposed pairs with said lateral locator means effecting lateral alignment of said cam key block means.

3. An interconnecting structure, as set forth in claim 2, wherein:

said cam key block has a longitudinal axis and a laterally transverse axis;

said lateral locator means comprises first and second lateral locators, each said lateral locator having a projecting lug and a recess located laterally of said projecting lug.

4. An interconnecting structure, as set forth in claim 3, wherein:

said projecting lug presented from said first lateral locator is disposed laterally on one side of said longitudinal axis; and, said projecting lug presented from said second lateral locator is disposed on the laterally opposite side of said longitudinal axis.

5. An interconnecting structure, as set forth in claim 3, wherein:

said projecting lug presented from said first lateral locator is disposed laterally on one side of said longitudinal axis; and, said projecting lug presented from second lateral locator is disposed on the same laterally side of said longitudinal axis.

6. An interconnecting structure, as set forth in claim, further comprising:

a retaining bolt means extending transversely outwardly from said disk portion;

said retaining bolt means being disposed intermediate said two locking bolt means.

7. An interconnecting structure, as set forth in claim 6, wherein:

said cam key block means has a longitudinal axis, a laterally transverse axis and a normal axis perpendicular to both said longitudinal and said laterally transverse axis;

a central slot extending through said cam key block parallel to said normal axis;

said cam key being at least partially received within said central slot.

8. An interconnecting structure, as set forth in claim 7, wherein:

bearing surfaces are provided in said cam key block, said bearing surfaces disposed concentrically of said laterally transverse axis, one said bearing surface located on either side of said central slot;

said cam key being rotatably journalled on said bearing surfaces.

9. An interconnecting structure, as set forth in claim 1, wherein:

said cam key block means has a body portion;

said body portion having a longitudinal axis, a laterally transverse axis and a normal axis;

a central slot extending through said body portion in parallel relation with said normal axis;

rib means presented within said central slot;

said cam surfaces presented from said rib means.

10. An interconnecting structure, as set forth in claim 9, further comprising:

bearing surfaces presented from said rib means;

said cam key means having a central hub;

said central hub journalled on said bearing surfaces.

11. An interconnecting structure, as set forth in claim 10, wherein:

a planar locking surface is presented from said locking bolt means to engage the cam surfaces on said rib means.

12. An interconnecting structure, as set forth in claim 11, further comprising:

a retaining bolt means extending transversely outwardly from said disk portion;

said retaining bolt means being disposed intermediate said two locking bolt means.

13. An interconnecting structure, as set forth in claim 12, wherein:

a spring detent means is associated with said cam key block means biasingly to engage said cam key means.

14. An interconnecting structure, as set forth in claim 13, wherein:

a detent recess is presented from said spring detent means; and said detent recess engages selected bolt means.

15. An interconnecting structure, as set forth in claim 1, wherein:

said cam key lock means has a longitudinal axis, a laterally transverse axis and a normal axis;

one of said cam key means is employed with each pair of opposed cam key block means;

an inner lock surface on one locking bolt means engaging the cam surfaces on one of the cam key block means;

another inner lock surface on another locking bolt means engaging the cam surfaces on the other of said pair of cam key block means;

said cam key having a hub rotatably disposed on the intersection of said longitudinal and said laterally transverse axes of said cam key block means, whereby said opposed cam key block means are maintained in abutment.

16. A relocatable wall comprising:

at least two successively adjacent wall panel assemblies to be joined as a relocatable wall;

each said wall panel assembly to be joined to a successive wall panel assembly having vertical frame members on at least that lateral edge to be so joined to a successive wall panel assembly;

at least one cam key block secured to each said vertical frame member;

each said cam key block having cam surfaces and bearing surfaces;

a cam key;

said cam key having a central hub portion and a disk portion;

locking bolt means extending transversely outwardly of said disk portion;

said locking bolt means located diametrically on said disk portion;

said control hub portion journalled in said bearing surfaces to permit selective rotation of said cam key;

said cam key being rotatable selectively to engage and disengage said locking bolt means from said cam surfaces.

17. A relocatable wall, as set forth in claim 16, wherein:

said locking bolt means are spaced diametrically on said disk portion; retaining bolt means are circumferentially spaced at approximately 90° between said locking bolt means.

18. A relocatable wall, as set forth in claim 17, wherein:

spring detent means are anchored between said cam key block and said vertical frame member in said wall panel assemblies;

said spring detent means presenting a detent recess;

said detent recess selectively engaging said locking and said retaining bolt means to determine the location of said bolt means.

19. A relocatable wall, as set forth in claim 16, wherein:

a post arrangement is interposed between successively converging wall panel assemblies.

20. A relocatable wall, as set forth in claim 19, wherein:

said post arrangement employs a post member and a gusset assembly to attach the desired number of cam key blocks to said post member.

21. A relocatable wall, as set forth in claim 20, wherein said gusset assembly conprises:

a pair of opposed U-shaped brackets; and, a plurality of spacer brackets secured to said U-shaped bracket.

22. A relocatable wall, as set forth in claim 21, wherein:

a cap is attached to said gusset assembly at those locations where no wall panel assembly is located.

23. A relocatable wall, as set forth in claim 22, wherein:

a filler block is supported by said gusset assembly to support said cap.

* * * * *

UNITED STATES PATENT AND TRADEMARK OFFICE

CERTIFICATE OF CORRECTION

PATENT NO. : 4,942,713

DATED : July 24, 1990

INVENTOR(S) : Francis G. Jackson

It is certified that error appears in the above-identified patent and that said Letters Patent is hereby corrected as shown below: On the Title page, In the Abstract, line 6, "assmelbies" should read --assemblies--; line 21, "invention cam" should read --invention can--.

Column 1, line 59, Patent No. "1,154,66" should read --1,154,622--; line 60, after "2,832,101" should read --3,694,975--.

Column 7, line 22, "slots (FIG. 1)" should read --slots 61 (FIG. 1)--.

Column 8, line 58, "also be" should read --also as--.

Column 10, line 41, "that is no" should read --there is no--; line 58, "accomplished be" should read --accomplished by--; and, line 61, "cam be" should read --can be--.

Column 14, line 3, "wall pane" should read --wall panel--; line 55, "cam key can" should read --cam key 75 can--.

Column 15, line 16, "modesty" should read --modestly--.

Column 17, line 6, "within the lugs" should read --within which the lugs--.

Column 18, line 15, "in claim, further" should read --in claim 1 further--.

Signed and Sealed this

Twenty-ninth Day of December, 1992

*Attest:*

DOUGLAS B. COMER

*Attesting Officer*

*Acting Commissioner of Patents and Trademarks*